US009786219B2

(12) United States Patent
Han

(10) Patent No.: US 9,786,219 B2
(45) Date of Patent: Oct. 10, 2017

(54) ORGANIC LIGHT EMITTING DISPLAY AND METHOD FOR AGING THE SAME

(71) Applicant: SAMSUNG DISPLAY CO., LTD., Yongin, Gyeonggi-Do (KR)

(72) Inventor: Byung-Uk Han, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 82 days.

(21) Appl. No.: 14/530,975

(22) Filed: Nov. 3, 2014

(65) Prior Publication Data

US 2015/0123962 A1 May 7, 2015

(30) Foreign Application Priority Data

Nov. 4, 2013 (KR) ..... 10-2013-0132751

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2310/0254* (2013.01); *G09G 2320/043* (2013.01); *G09G 2330/028* (2013.01)

(58) Field of Classification Search
CPC ... G09G 2300/0819; G09G 2300/0842; G09G 2310/0254; G09G 2320/043; G09G 2330/028; G09G 3/3233
See application file for complete search history.

(56) References Cited

U.S. PATENT DOCUMENTS

| | | | | |
|---|---|---|---|---|
| 7,952,273 | B2 | 5/2011 | Do et al. | |
| 8,054,253 | B2 | 11/2011 | Yoo | |
| 2002/0084464 | A1* | 7/2002 | Yamazaki | H01L 27/3246 257/89 |
| 2006/0044229 | A1* | 3/2006 | Yamazaki | G09G 3/2022 345/76 |
| 2007/0195020 | A1* | 8/2007 | Nathan | G09G 3/3233 345/76 |
| 2007/0273294 | A1* | 11/2007 | Nagayama | G09G 3/006 315/169.3 |
| 2008/0169460 | A1* | 7/2008 | Yoo | G09G 3/3233 257/40 |
| 2008/0186301 | A1* | 8/2008 | Park | G09G 3/3233 345/211 |
| 2009/0278835 | A1 | 11/2009 | Ka | |

(Continued)

FOREIGN PATENT DOCUMENTS

| | | |
|---|---|---|
| JP | 2006-210213 A | 8/2006 |
| KR | 10-2006-0033132 A | 4/2006 |
| KR | 10-0835988 | 6/2008 |

(Continued)

*Primary Examiner* — Lun-Yi Lao
*Assistant Examiner* — Kelly Hegarty
(74) *Attorney, Agent, or Firm* — Lee & Morse, P.C.

(57) ABSTRACT

An organic light emitting display panel includes a plurality of pixels, each of which includes an organic light emitting diode and each coupled to a first power voltage line. A voltage supplied to the first power voltage line in a display mode is lower than a voltage supplied to the first power voltage line in an aging mode. The display mode includes a mode in which the organic light emitting diode emits light. The aging mode includes a mode in which the organic light emitting diode does not emit light.

20 Claims, 4 Drawing Sheets

(56) References Cited

U.S. PATENT DOCUMENTS

2011/0080173 A1* 4/2011 Kim ..... G09G 3/006
324/403
2011/0141000 A1* 6/2011 Han ..... G09G 3/3233
345/82

FOREIGN PATENT DOCUMENTS

KR 10-2009-0116334 A 11/2009
KR 10-2011-0043259 A 4/2011

* cited by examiner

ORGANIC LIGHT EMITTING DISPLAY AND METHOD FOR AGING THE SAME

CROSS-REFERENCE TO RELATED APPLICATION

Korean Patent Application No. 10-2013-0132751, filed on Nov. 4, 2013, and entitled, "ORGANIC LIGHT EMITTING DISPLAY AND METHOD FOR AGING THE SAME," is incorporated by reference herein in its entirety.

BACKGROUND

1. Field

One or more embodiments described herein relate to a display.

2. Description of the Related Art

A variety of flat panel displays have been developed. Examples include liquid crystal displays, plasma display panels, and organic light emitting displays. Among these, organic light emitting displays have low-voltage driving, thin, excellent viewing angle, and fast response speed.

Organic light emitting displays generate an image based on light emitted from organic light emitting diodes (OLEDs). The lifespan of an organic light emitting display is related to the lifespan of its OLEDs. In order to extend the lifespan of the OLED, an aging process of applying high-temperature heat to the OLEDs for a predetermined period has been proposed. This process may stabilize the surface characteristic of the OLEDs, thereby extending their lifespans. However, existing methods have drawbacks.

SUMMARY

In accordance with one embodiment, an organic light emitting display includes a display panel including a plurality of pixels, each of the pixels including an organic light emitting diode and coupled to a first power voltage line, wherein a voltage supplied to the first power voltage line in a display mode is lower than a voltage supplied to the first power voltage line in an aging mode, wherein the display mode includes a mode in which the organic light emitting diode emits light and the aging mode includes a mode in which the organic light emitting diode does not emit light.

The first power voltage line may be coupled to a cathode electrode of the organic light emitting diode. The display may include a second power voltage line coupled to each of the pixels, and a voltage supplied to the second power voltage line in the aging mode may be higher than the voltage supplied to the first power voltage line in the display mode.

The voltage supplied to the second power voltage line in the aging mode may be substantially equal to a voltage supplied to the second power voltage line in the display mode. The voltage supplied to the second power voltage line in the aging mode may be substantially equal to the voltage supplied to the first power voltage line in the aging mode.

The display panel may include a third power voltage line, and a voltage supplied to the third power voltage line in the aging mode may be substantially equal to a voltage supplied to the second power voltage line in the display mode. The voltage supplied to the third power voltage line in the aging mode may be substantially equal to the voltage supplied to the first power voltage line in the aging mode.

Each of the pixels may include a driving transistor and a plurality of switch transistors, the organic light emitting diode is to emit light based on drain-source current of the driving transistor in the display mode, and the plurality of switch transistors are to be turned off in the aging mode.

In accordance with another embodiment, a method for aging an organic light emitting display includes supplying voltages to a first power voltage line in a display mode and an aging mode, the voltage supplied to the first power voltage line in the display mode is lower than a voltage supplied to the first power voltage line in the aging mode; and controlling the organic light emitting diode to not emit light during the aging mode, wherein the display mode includes a mode in which an organic light emitting diode of a pixel coupled to the first power voltage line emits light and the aging mode includes a mode in which the organic light emitting diode does not emit light.

The first power voltage line may be coupled to a cathode electrode of the organic light emitting diode. The method may include supplying a voltage to a second power voltage line in the aging mode, wherein the voltage supplied to the second power voltage line in the aging mode is higher than the voltage supplied to the first power voltage line in the display mode.

The method may include supplying a voltage to the third power voltage line in the aging mode, wherein the voltage supplied to the third power voltage line in the aging mode is substantially equal to a voltage supplied to the second power voltage line in the display mode.

In accordance with another embodiment, an apparatus includes a timing controller; and a power supply to supply voltages to first and second power lines coupled to a pixel, wherein the power supply is to supply first and second voltages to respective ones of the first and second power lines in display mode and is to supply third and fourth voltages to respective ones of the first and second power lines during an aging mode, and wherein the timing controller is to control the pixel so that the pixel does not emit light during the aging mode.

The first and second voltages may be different in the display mode, and the third and fourth voltages may be greater than at least one of the first or second voltages in the aging mode. The third voltage may be substantially equal to the fourth voltage. The second voltage may be greater than the first voltage, and the third and fourth voltages may be substantially equal.

The third and fourth voltages may generate Joule heat to age at least the pixel. The third and fourth voltages may be applied during a module process or a setting process of a display panel including the pixel. The timing controller may withhold outputting at least one of a scan signal or a data signal to the pixel during the aging mode. The third and fourth voltages may be supplied before a scribing process and after the pixel is formed on a mother substrate

BRIEF DESCRIPTION OF THE DRAWINGS

Features will become apparent to those of skill in the art by describing in detail exemplary embodiments with reference to the attached drawings in which.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
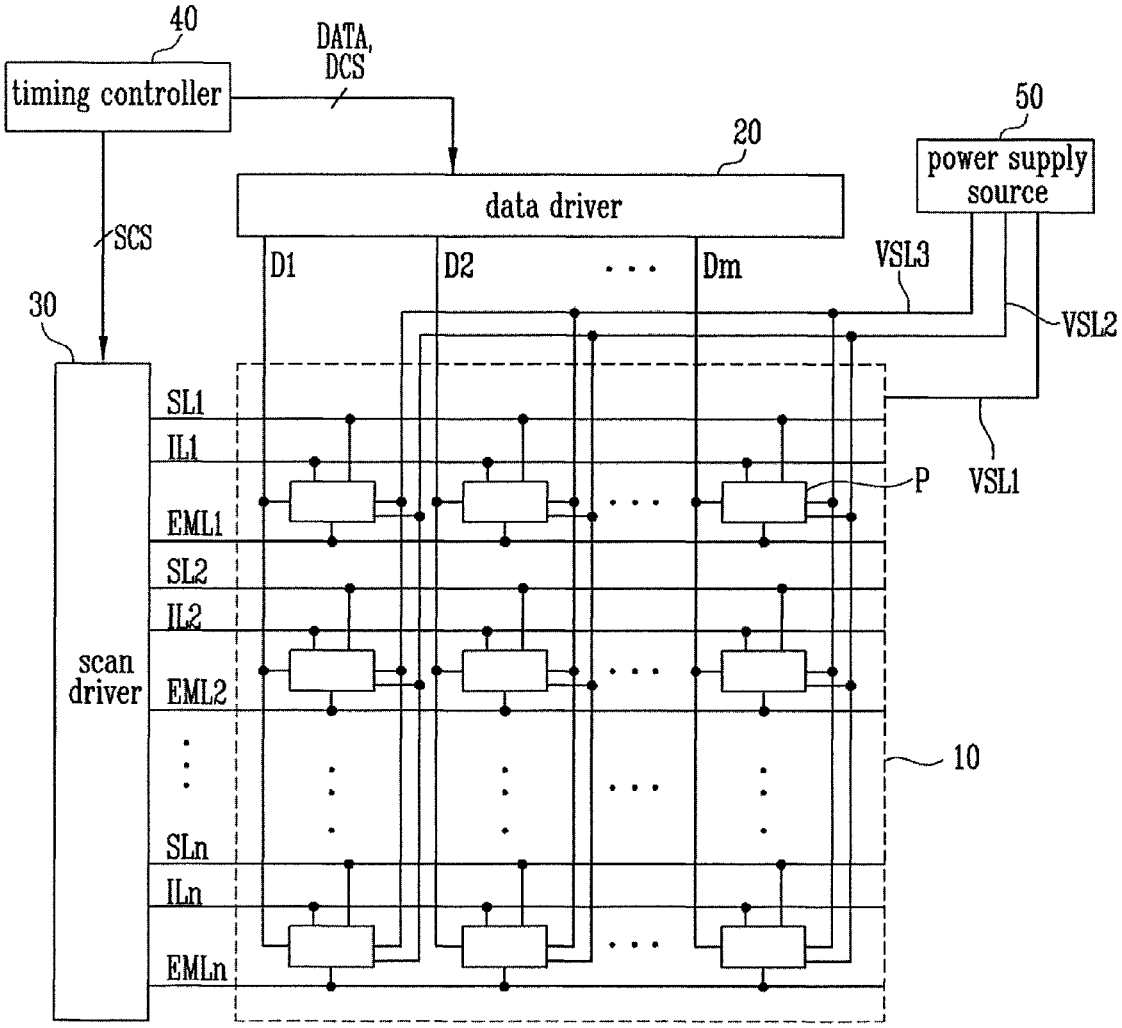
FIG. 1 illustrates an embodiment of an organic light emitting display.

FIG. 1 illustrates an embodiment of an organic light emitting display which includes a display panel 10, a data driver 20, a scan driver 30, a timing controller 40, and a power supply unit 50.

Data lines D1 to Dm and scan lines SL1 to SLn are formed to intersect each other in the display panel 10, where m≥2 and n≥2. Initialization lines IL1 to ILn and emission lines EML1 to EMLn are formed parallel to the scan lines SL1 to SLn in the display panel 10. Pixels P are arranged in a matrix form in the display panel 10.

The data driver 20 includes at least one source driver IC. The source driver IC receives digital video data DATA from the timing controller 40. The source driver IC generates data voltages by converting digital video data DATA to gamma compensation voltage(s) in response to a source timing control signal DCS from the timing controller 40. The data voltages are supplied to the data lines D1 to Dm of the display panel 10 synchronized with a scan signal SCAN. Accordingly, a data voltage is supplied to each pixel P which receives the scan signal SCAN.

The scan driver 30 includes a scan signal driving circuit, an initialization signal driving circuit, and an emission signal driving circuit. Each of the scan signal driving circuit, the initialization signal driving circuit, and the emission signal driving circuit may include a shift register for sequentially outputting output signals, a level shifter for shifting the output signals of the shift register with a swing width suitable for driving transistors of the pixel P, and an output buffer.

The scan signal driving circuit sequentially supplies a scan signal to the scan lines SL1 to SLn of the display panel 10. The initialization signal driving circuit sequentially supplies an initialization signal to the initialization lines IL1 to ILn of the display panel 10. The emission signal driving circuit sequentially supplies an emission signal to the emission lines EML1 to EMLn of the display panel 10.

The timing controller 40 receives digital video data DATA from a host system through an interface, e.g., a low voltage differential signaling (LVDS) interface or a transition minimized differential signaling (TMDS) interface. In addition, the timing controller 40 receives timing signals such as a vertical synchronization signal, a horizontal synchronization signal, a data enable signal, and/or a dot clock from the host system.

The timing controller 40 generates timing control signals for controlling operation of the data driver 20 and the scan driver 30. The timing control signals include a scan timing control signal SCS for controlling operation timing of the scan driver 30, and a data timing control signal DCS for controlling operation timing of the data driver 20. The timing controller 40 outputs the scan timing control signal SCS to the scan driver 30, and outputs the data timing control signal DCS and the digital video data DATA to the data driver 20.

The power supply unit 50 receives a predetermined voltage from a battery in the organic light emitting display or an external power supply source. The power supply unit 50 supplies first to third power voltages to first to third power voltage lines VSL1, VSL2, and VSL3, respectively. The first power voltage line VSL1 is coupled to a cathode electrode CAT of an organic light emitting diode in each pixel P. The second and third voltage lines VSL2 and VSL3 are coupled to each pixel P. The power supply unit 50 may supply a gate-on voltage and a gate-off voltage to the scan driver 30.

Figure 2:
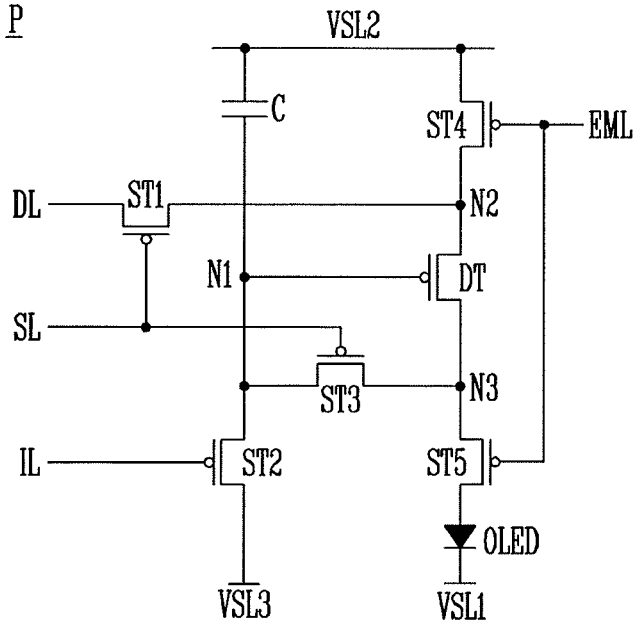
FIG. 2 illustrates an embodiment of a pixel.

FIG. 2 illustrates an embodiment of a pixel P, which, for example, may correspond the pixels in FIG. 1. Referring to FIG. 2, the pixel P includes a driving transistor DT, an organic light emitting diode OLED, a plurality of switch transistors ST1, ST2, ST3, ST4, and ST5, and a capacitor C. The plurality of switch transistors are controlled by a scan signal, an initialization signal, and an emission signal respectively supplied through a scan line SL, an initialization line IL, and an emission line EM. One or more of these signals are used to effect compensation of the threshold voltage Vth of the driving transistor DT. The pixel P is also coupled to first to third power voltage lines VSL1, VSL2, and VSL3.

The driving transistor DT controls current Ids between drain and source based on a gate voltage. As the difference between the threshold voltage of the driving transistor DT and the voltage of the gate source electrodes of the driving transistor DT increases, the drain-source current Ids of the driving transistor DT, flowing through a channel of the driving transistor DT, increases. The driving transistor DT includes a gate electrode coupled to a first node N1, a first electrode coupled to a second node N2, and a second electrode coupled to a third node N3. The first and second electrodes may be source and drain electrodes. For example, if the first electrode is the source electrode, the second electrode may be the drain electrode, and vice versa.

The organic light emitting diode OLED includes an anode electrode coupled to a second electrode of a fifth transistor ST5 and a cathode electrode coupled to the first power voltage line VSL1. The organic light emitting diode OLED emits light based on the drain-source current Ids of the driving transistor DT. The amount of the light emitted in the organic light emitting diode OLED may be in proportion to the drain-source current Ids of the driving transistor DT.

A first transistor ST1 is turned on by the scan signal from the scan line SL. When the first transistor ST1 turns on, the second node N2 is coupled to the data line DL. Therefore, a data voltage of the data line DL is supplied to the second node N2. The first transistor ST1 includes a gate electrode coupled to the scan lines SL, a first electrode coupled to the data line DL, and a second electrode coupled to the second node N2.

A second transistor ST2 is turned on by the initialization signal from the initialization line IL. When the second transistor ST2 turns on, the first node N1 is coupled to the third power voltage line VSL3. Therefore, the first node N1 is initialized to a voltage supplied through the third power voltage line VSL3. The second transistor ST2 includes a gate electrode coupled to the initialization line IL, a first electrode coupled to the first node N1, and a second electrode coupled to the third power voltage line VSL3.

A third transistor ST3 is turned on by the scan signal from the scan line SL. When the third transistor ST3 turns on, the first node N1 is coupled to the third node N3. In this case, the gate electrode and the second electrode of the driving transistor DT are coupled to each other, thereby placing the driving transistor DT in a diode-connected state. The third transistor ST3 includes a gate electrode coupled to the scan line SL, a first electrode coupled to the third node N3, and a second electrode coupled to the first node N1.

A fourth transistor ST4 allows the second node N2 to be coupled to the second power voltage line VSL2 in response to the emission signal from the emission line EML. Therefore, a voltage from the second power voltage line VSL2 is supplied to the second node N2. The fourth transistor ST4 includes a gate electrode coupled to the emission line EML, a first electrode coupled to the second power voltage line VSL2, and a second electrode coupled to the second node N2.

The fifth transistor ST5 is turned on by the emission signal from the emission line EML. When the fifth transistor ST5 turns on, the third node N3 is coupled to the anode electrode of the organic light emitting diode OLED. The fifth transistor ST5 includes a gate electrode coupled to the emission line EML, a first electrode coupled to the third node N3, and the second electrode coupled to the anode electrode of the organic light emitting diode OLED. The drain-source current Ids of the driving transistor DT is supplied to the organic light emitting diode OLED when the fourth and fifth transistors ST4 and ST5 are turned on.

The capacitor C is coupled between the first node N1 and the second power voltage line VSL2. One electrode of the capacitor C is coupled to the first node N1. The other electrode of the capacitor C is coupled to the second power voltage line VSL2.

A semiconductor layer of each of the first to fifth transistors ST1, ST2, ST3, ST4, and ST5 and the driving transistor DT may be formed of a-Si, an oxide, or poly silicon. Although the first to fifth transistors ST1, ST2, ST3, ST4 and ST5 and the driving transistor DT are illustrated to be P-type metal oxide semiconductor field effect transistors (MOSFETs), these transistors may be implemented as N-type MOSETs in other embodiments, or a combination of N-type and P-type MOSFETs.

In this embodiment, the pixel P is operated in a frame period divided into an initialization period, a data voltage supply period, and an emission period. The initialization period is a period in which the first node N1 is initialized. The data voltage supply period is a period in which a data voltage is supplied to the gate electrode of the driving transistor DT. The emission period is a period in which the organic light emitting diode OLED emits light.

During the initialization period, the first, second, fourth, and fifth transistors ST1, ST2, ST4, and ST5 are turned off and the third transistor ST3 is turned on. The first node N1 is initialized to an initialization voltage when the second transistor ST2 turns on under these conditions.

During the data voltage supply period, the second, fourth, and fifth transistors ST2, ST4, and ST5 are turned off and the first and third transistors ST1 and ST3 are turned on. The voltage of the first and third nodes N1 and N3 rises up to "Vdata+Vth" when the first and third transistors ST1 and ST3 turn on under these conditions.

During the emission period, the first to third transistors ST1, ST2, and ST3 are turned off and the fourth and fifth transistors ST4 and ST5 are turned on. The driving transistor DT supplies the current Ids between the drain and source to the organic light emitting diode OLED, based on the voltage "Vdata+Vth" of the first node N1, when the fourth and fifth transistors ST4 and ST5 turn on under these conditions.

The organic light emitting diode OLED of the pixel P emits light based on the drain-source current Ids of the driving transistor DT. Because the voltage of the first node N1 includes the threshold voltage of the driving transistor DT, the drain-source current Ids of the driving transistor DT does not rely on the threshold voltage. Thus, the threshold voltage Vth of the driving transistor DT may be compensated.

Figure 3:
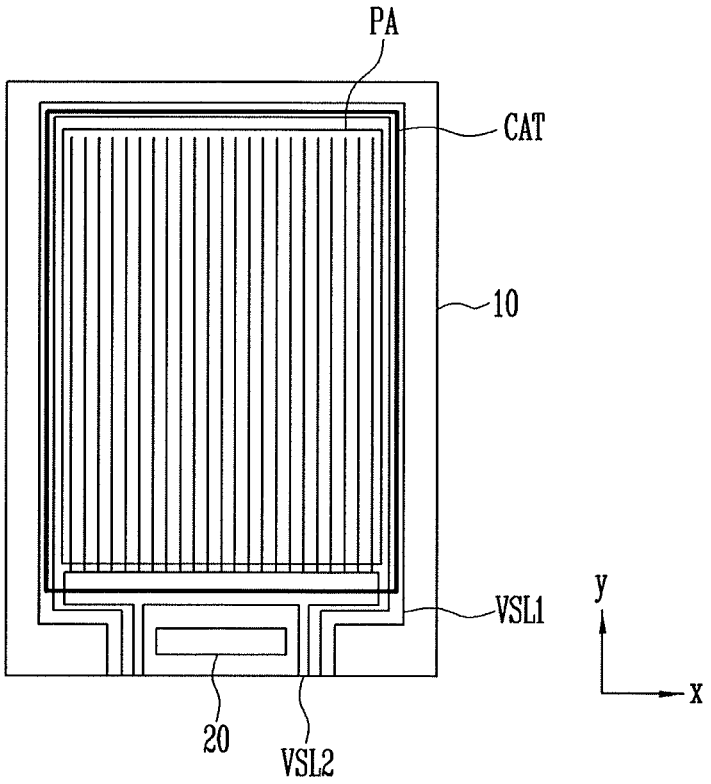
FIG. 3 illustrates a first power voltage line, a second power voltage line, and a cathode electrode in a display panel according to one embodiment.

FIG. 3 illustrates one embodiment of the first power voltage line, the second power voltage line, and the cathode electrode in the display panel of FIG. 1. For convenience of illustration, only the first power voltage line VSL1, the second power voltage line VSL2, and the cathode electrode CAT are shown in FIG. 3.

Referring to FIG. 3, a pixel array PA including the pixels P is formed in the display panel 10. The data driver 20 may be mounted at a lower side of the pixel array PA. The scan driver 30 may be located at respective sides of the pixel array PA.

The first power voltage line VSL1, as shown in FIG. 3, is formed to surround the sides and an upper side of the pixel array PA. The second power voltage line VSL2 may be formed in a vertical (e.g., y-axis) direction extending from the lower side to the upper side of the pixel array PA. The second power voltage line VSL2 is coupled to each pixel P in the pixel array PA.

In one embodiment, the second power voltage line VSL2 is formed in every space between pixels adjacent in a horizontal (x-axis) direction. The first and second power voltage lines VSL1 and VSL2 may be coupled to a flexible printed circuit board or flexible film. The flexible printed circuit board or flexible film may be coupled to a printed circuit board on which the power supply unit 50 is mounted.

In one embodiment, the third power voltage line VSL3 may be formed together with the second power voltage line VSL2. For example, the third power voltage line VSL3 may be formed in the vertical direction extending from the lower side of the pixel array PA to the upper side of the pixel array PA, and may be coupled to each pixel P in the pixel array PA.

Also, in one embodiment, the third power voltage line VSL3 may be formed in every space between the pixels adjacent in the horizontal direction. In this case, the second and third power voltage lines VSL2 and VSL3 may avoid being short-circuited. Therefore, the third power voltage line VSL3 may be located in a layer different from that of the second power voltage line VSL2. The second and third power voltage lines VSL2 and VSL3 may or may not overlap one another in these different layers.

The cathode electrode CAT may be formed on the pixel array PA as shown in FIG. 3. The cathode electrode CAT may be formed as one electrode having an area wider than that of the pixel array PA. The cathode electrode CAT may contact the first power voltage line VSL1.

The organic light emitting display may operate in display mode or aging mode. The display mode may include a mode in which an image is displayed as a result of the emission of light from the organic light emitting diodes of the pixels. The aging mode may include a mode in which an image is not displayed as a result of controlling the organic light emitting diodes of the pixels not to emit light. After fabrication of the display panel 10 is completed, the aging mode may be performed in a module process, a test process, or another process, before the product is released.

Figure 4:
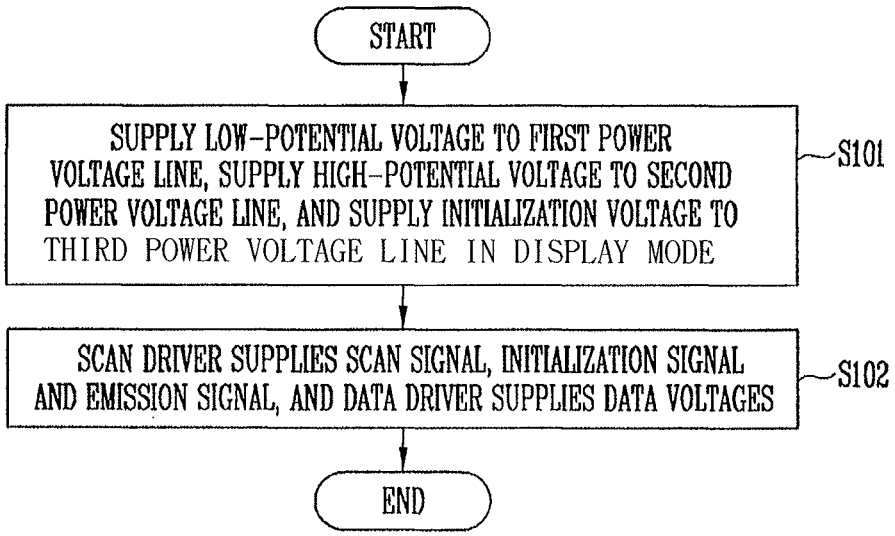
FIG. 4 illustrates an embodiment of a method for controlling an organic light emitting display in display mode.

FIG. 4 illustrates operation of the organic light emitting display in the display mode according to one embodiment. Operations of the data driver 20, the scan drive 30, the timing controller 40, and the power supply unit 50 of the organic light emitting display in the display mode are described in detail with reference to FIG. 4.

First, in the display mode, the power supply unit 50 supplies a first power voltage to the first power voltage line VSL1, supplies a second power voltage to the second power voltage line VSL2, and supplies a third power voltage for initializing the gate electrode of the driving transistor DT to the third power voltage line VSL3. In one embodiment, the first power voltage may be a low-potential voltage, the second power voltage may be a high-potential voltage, and the third power voltage may be an initialization voltage. The high-potential voltage may be the higher voltage than the low-potential voltage and the initialization voltage (S101). In other embodiments, the first, second, and third power voltages may have different voltage levels.

Second, in the display mode, the timing controller 40 receives digital video data DATA and a timing signal from a host system. The timing controller 40 generates a data timing control signal DCS for controlling operation timing of the data driver 20 and a scan timing control signal SCS for controlling operation timing of the scan driver 30, based on the timing signal. The timing controller 40 outputs the scan timing control signal SCS to the scan driver 30, and outputs the data timing control signal DCS and the digital video data DATA to the data driver 20.

The scan driver 30 sequentially outputs a scan signal to the scan lines SL1 to SLn, sequentially outputs an initialization signal to the initialization lines IL1 to ILn, and sequentially outputs an emission signal to the emission lines EM1 to EMn. The data driver 20 outputs data voltages, converted from the digital video data DATA, to respective ones of the data lines D1 to Dm (S102).

As a result, in the display mode, each pixel P of the display panel 10 receives the high-potential voltage, the initialization voltage, and the low-potential voltage, respectively supplied from the first to third power voltage lines VSL1, VSL2 and VSL3. Each pixel P also receives the scan signal, the initialization signal, and the emission signal from the scan line SL, the initialization line IL, and the emission line EML, respectively. Thus, the current between the drain and source of the driving transistor DT may be supplied to the organic light emitting diode OLED, as described in conjunction with FIG. 2. Accordingly, the organic light emitting diode OLEDs of the pixels P emit light to display an image.

Figure 5:
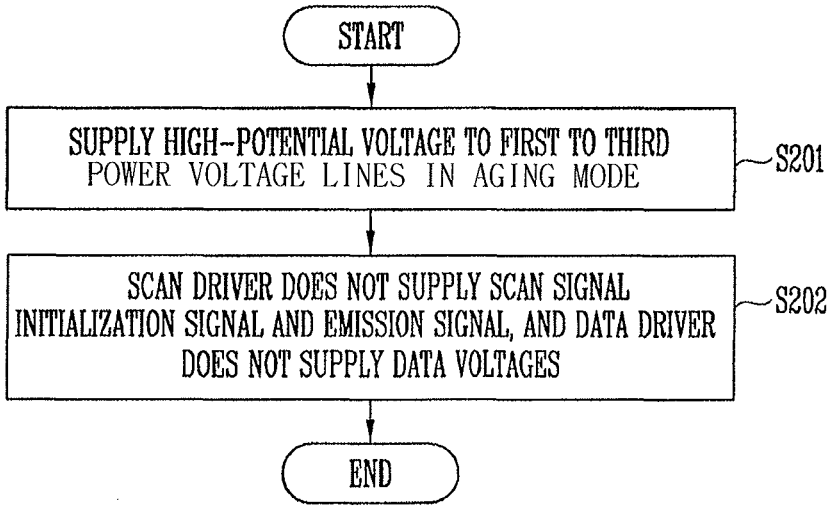
FIG. 5 illustrating an embodiment of a method for controlling an organic light emitting display in aging mode.

FIG. 5 illustrating operation of the organic light emitting display in the aging mode according to one embodiment. Operations of the data driver 20, the scan driver 30, the timing controller 40 and the power supply unit 50 of the organic light emitting display in the aging mode are described in detail with reference to FIG. 5.

First, in the aging mode, the power supply unit 50 supplies a high-potential voltage to each of the first to third power voltage lines VSL1 to VSL3. The high-potential voltage is a voltage which is supplied to the second power voltage line VSL2 in the display mode. the voltage supplied to each of the first to third power voltage lines VSL1 to VSL3 is not limited to the high-potential voltage. The voltage supplied to each of the first to third power voltage lines VSL1 to VSL3, for example, may be a voltage higher than that of the high-potential voltage (S201).

Second, in the aging mode, the timing controller 40 does not receive the digital video data DATA and the timing signal from the host system. Thus, the timing controller 40 does not generate the data timing control signal DCS and the scan timing control signal SCS. Accordingly, the timing controller 40 does not output the scan timing control signal SCS to the scan driver 30, and does not output the data timing control signal DCS and the digital video data DATA to the data driver 20.

Therefore, the scan driver 30 does not output the scan signal to the scan lines SL1 to SLn, does not output the initialization signal to the initialization signal to the initialization lines IL1 to ILn, and does not output the emission signal to the emission lines EM1 to EMn. The data driver 30 does not output the data voltages to the data lines D1 to Dm (S202).

As a result, in the aging mode, each pixel P of the display panel 10 receives the high-potential voltage supplied from each of the first to third power voltage lines VSL1, VSL2, and VSL3, and does not receive the scan signal, the initialization signal and the emission signal from the scan line SL, the initialization line IL, and the emission line EML, respectively. Therefore, the switch transistors of each pixel P are turned off. As a result, the organic light emitting diode OLED of each pixel P does not emit light. For example, current does not flow through the organic light emitting diode OLED to cause the organic light emitting diode OLED of each pixel P to emit light. Therefore, the voltage supplied to the cathode electrode of the organic light emitting diode OLED is higher than that supplied to the anode electrode of the organic light emitting diode OLED.

When the high-potential voltage is supplied to each of the first to third power voltage lines VSL1, VSL2, and VSL3, Joule heat is generated in each of the first to third power voltage lines VSL1, VSL2, and VSL3 due to the high voltage. Joule heat refers to heat generated by high resistance when a voltage is applied to a line having the high resistance. Each of the first to third power voltage lines VSL1, VSL2, and VSL3 may be formed throughout the entire area of the display panel. The resistance of the line is in proportion to the length of the line and in inversely proportion to the cross-sectional area of the line. Therefore, the resistance of each of the first to third power voltage lines VSL1, VSL2, and VSL3 is high. As a result, in this embodiment, heat may be applied to the organic light emitting diode OLED for a predetermined period using the Joule heat of the first to third power voltage lines VSL1, VSL2, and VSL3 in the aging mode. As a result, aging of the organic light emitting diode OLED is possible.

Particularly, in order to affect aging in a related art organic light emitting display, a substrate having an organic light emitting diode formed thereon was placed in a chamber at a high temperature of 70° C. for about 48 hours during a manufacturing process.

However, in the present embodiment, aging may be performed after a module process or setting process using the aging mode. The module process is a process of assembling a guide/case member, for supporting the display panel 10, to the display panel 10, mounting the data driver 20 on the display panel 10, and coupling a printed circuit board (on which the timing controller 40, the power supply unit 50 and the like are mounted) to the display panel 10. The setting process refers to a process of covering a case on a completed module to be released as an end product.

As a result, in this embodiment, aging may be performed on the organic light emitting diode OLED using the aging mode in the module process or setting process. As a result, the time the substrate is in the high-temperature chamber in order to perform aging may be reduced or omitted relative to the related art organic light emitting display.

Although a high-potential voltage is applied to all of the first to third power voltage lines VSL1, VSL2, and VSL3 in this embodiment, a high-potential voltage may be supplied to any one of the first to third power voltage lines VSL1, VSL2, and VSL3, or may be supplied to any two of the first to third power voltage lines VSL1, VSL2, and VSL3, in the aging mode in other embodiments.

Also, in one embodiment, aging may be performed on the organic light emitting diode OLED using Joule heat in the aging mode in the module process or setting process. As a result, it is possible to reduce or omit the amount of time the substrate spends in the high-temperature chamber relative to the related art organic light emitting display.

The method for aging the organic light emitting diode OLED of the organic light emitting display in the module process or setting process has been described in conjunction with FIGS. 1 to 5. In other embodiments, aging may be performed before a scribing process, after a plurality of display panel cells are formed on a mother substrate. The scribing process may include a process of cutting a plurality of display panel cells on a mother substrate. Each of the plurality of display panel cells on the mother substrate may be the same as in FIGS. 1 and 3.

Figure 6:
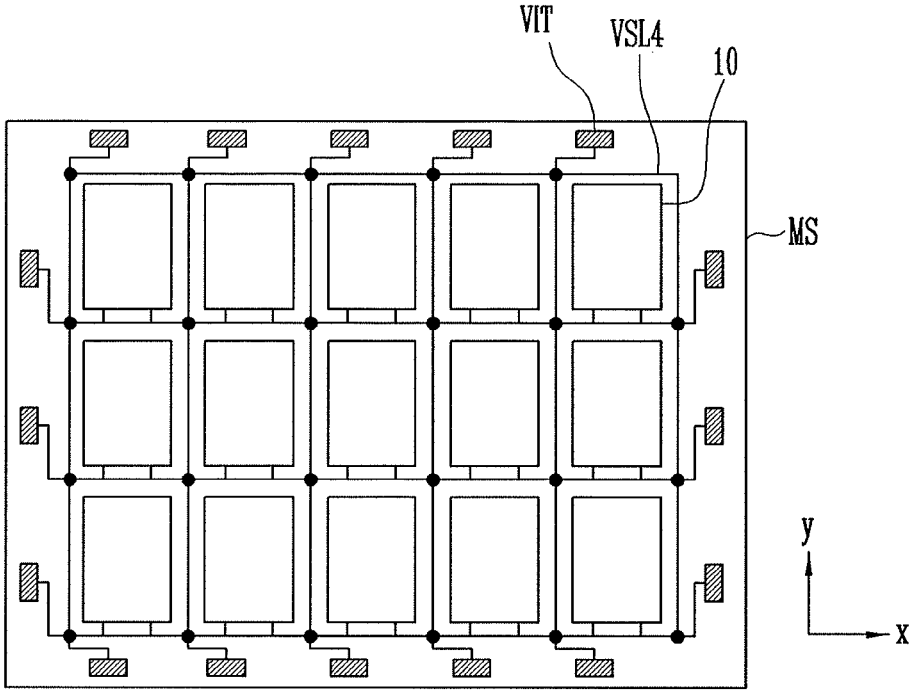
FIG. 6 illustrates display panel cells and a fourth power voltage line according to one embodiment.

FIG. 6 illustrates display panel cells and a fourth power voltage line formed on a mother substrate according to one embodiment. Referring to FIG. 6, a plurality of display panel cells 10 are formed on a mother substrate MS. A fourth power voltage line VSL4 coupled to each of the plurality of display panel cells 10 is formed on the mother substrate MS. The fourth power voltage line VSL4 is coupled to all the display panel cells 10 on the mother substrate 10. The fourth power voltage line VSL4 may be coupled to all the first to third power voltage lines VSL1 to VSL3 in the display panel cell 10. In another embodiment, the fourth power voltage line VSL4 may be coupled to any one or two of the first to third power voltage lines VSL1 to VSL3.

A voltage input terminal VIT for supplying a predetermined voltage to the fourth power voltage line VSL4, through a jig or the like, may be formed on the mother substrate MS. The predetermined voltage may be a high-potential voltage or a voltage having a level higher than that of the high-potential voltage. A plurality of voltage input terminals VIT may be formed, so that a potential difference does not occur based on the position of the fourth power voltage line VSL4.

As a result, the high-potential voltage is supplied to the voltage input terminal VIT of the mother substrate MS before a scribing process and after the plurality of display panel cells are formed on the mother substrate MS. Thus, the high-potential voltage may be supplied to the first to third power voltage lines VSL1 to VSL3 of each of the plurality of display panel cells 10. Therefore, Joule heat may be generated in the first to third power voltage lines VSL1 to VSL3. Accordingly, in this embodiment, aging may be performed on the organic light emitting diode OLED using the Joule heat generated before the scribing process and after the plurality of display panel cells are formed on the mother substrate. As a result, the time the substrate is placed in the high-temperature chamber in order to perform aging may be reduced or omitted relative to the related art organic light emitting display.

Figure 7:
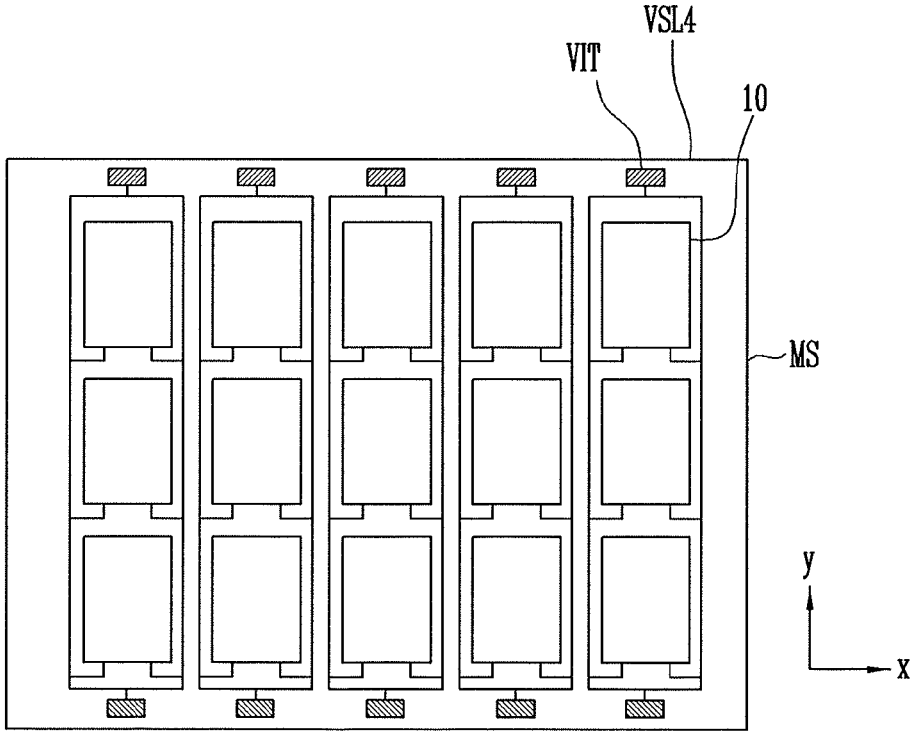
FIG. 7 illustrates display panel cells and a fourth power voltage line according to another embodiment.

FIG. 7 illustrates the display panel cells and the fourth power voltage line formed on the mother substrate according to another embodiment. The display panel cells and the fourth power voltage line may be the same as in FIG. 6, except that the fourth power voltage line VSL4 is coupled to a plurality of display panel cells 10 arranged in parallel in the vertical direction. In this embodiment, the fourth power voltage line VSL4 may be coupled to a plurality of display panel cells 10 arranged in parallel in the horizontal direction.

By way of summation and review, organic light emitting displays generate an image based on light emitted from organic light emitting diodes (OLEDs). The lifespan of an organic light emitting display is related to the lifespan of its OLEDs. In order to extend the lifespan of the OLED, an aging process of applying high-temperature heat to the OLEDs for a predetermined period has been proposed. This process may stabilize the surface characteristic of the OLEDs, thereby extending their lifespans. However, existing methods have drawbacks.

For example, according to one proposed method, a substrate having an OLED formed thereon is placed in a chamber at a high temperature of 70° C. for about 48 hours in order to perform an aging process. Because this aging process is performed during a manufacturing process of the organic light emitting display, the manufacturing process is increased.

In accordance with one or more of the aforementioned embodiments, pixels are not operated in the aging mode, and Joule heat is generated by supplying a high-potential voltage to the first to third power voltage lines. As a result, aging may be performed on the organic light emitting diode using the Joule heat in the aging mode in a module process or setting process. As a result, it is possible to reduce or omit the time the substrate is placed in a high-temperature chamber in order to perform aging relative to a related art organic light emitting diode display.

In accordance with these or other embodiments, a high-potential voltage is supplied to the voltage input terminal of the mother substrate before a scribing process and after a plurality of display panel cells are formed on the mother substrate. Thus, the high-potential voltage may be supplied to the first to third power voltage lines of each of the plurality of display panel cells, thereby generating Joule heat.

As a result, aging may be performed on the organic light emitting diode using the Joule heat before the scribing process and after the plurality of display panel cells are formed on the mother substrate. The time the substrate is placed in the high-temperature chamber in order to perform aging may therefore be reduced or omitted relative to a related art organic light emitting diode display.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display, comprising:

a first power voltage line; and a display panel including a plurality of pixels, each of the pixels including an organic light emitting diode coupled to the first power voltage line, a driving transistor, and switches to control operation of the organic light emitting diode, at least one of the switches coupled to an anode electrode of the organic light emitting diode, wherein a first voltage supplied to the first power voltage line in a display mode is lower than a second voltage supplied to the first power voltage line in an aging mode, the first power voltage line to receive the second voltage to age the organic light emitting diode by Joule heating independently from an applied scan signal or data signal, wherein the display mode includes a mode in which the organic light emitting diode emits light and the aging mode includes a mode in which the organic light emitting diode does not emit light and the driving transistor and the switches are turned off.

2. The display as claimed in claim 1, wherein the first power voltage line is coupled to a cathode electrode of the organic light emitting diode.

3. The display as claimed in claim 2, further comprising:

a second power voltage line is coupled to each of the pixels, wherein a voltage supplied to the second power voltage line in the aging mode is higher than the voltage supplied to the first power voltage line in the display mode.

4. The display as claimed in claim 3, wherein the voltage supplied to the second power voltage line in the aging mode is substantially equal to a voltage supplied to the second power voltage line in the display mode.

5. The display as claimed in claim 3, wherein the voltage supplied to the second power voltage line in the aging mode is substantially equal to the voltage supplied to the first power voltage line in the aging mode.

6. The display as claimed in claim 3, further comprising:

a third power voltage line, wherein a voltage supplied to the third power voltage line in the aging mode is substantially equal to a voltage supplied to the second power voltage line in the display mode.

7. The display as claimed in claim 6, wherein the voltage supplied to the third power voltage line in the aging mode is substantially equal to the second voltage supplied to the first power voltage line in the aging mode.

8. The display as claimed in claim 6, wherein the switches are switch transistors, the organic light emitting diode is to emit light based on drain-source current of the driving transistor in the display mode, and the plurality of switch transistors, which corresponding to the switches to control operation of the organic light emitting diode, are to be turned off in the aging mode.

9. A method for aging an organic light emitting display, the method comprising:

turning off a driving transistor and switches controlling operation of an organic light emitting diode in an aging mode, the switches including a switch connected to an anode electrode of the organic light emitting diode;

supplying voltages to a first power voltage line in a display mode and the aging mode, a first voltage supplied to the first power voltage line in the display mode is lower than a second voltage supplied to the first power voltage line in the aging mode; and controlling the organic light emitting diode to not emit light during the aging mode, wherein supplying the second voltage to the first power voltage line ages the organic light emitting diode by Joule heating independently from an applied scan signal or data signal, and wherein the display mode includes a mode in which an organic light emitting diode of a pixel coupled to the first power voltage line emits light and the aging mode includes a mode in which the organic light emitting diode does not emit light.

10. The method as claimed in claim 9, wherein the first power voltage line is coupled to a cathode electrode of the organic light emitting diode.

11. The method as claimed in claim 9, further comprising:

supplying a voltage to a second power voltage line in the aging mode, wherein the voltage supplied to the second power voltage line in the aging mode is higher than the voltage supplied to the first power voltage line in the display mode.

12. The method as claimed in claim 11, further comprising:

supplying a voltage to a third power voltage line in the aging mode, wherein the voltage supplied to the third power voltage line in the aging mode is substantially equal to a voltage supplied to the second power voltage line in the display mode.

13. An apparatus, comprising:

a timing controller; and a power supply to supply voltages to first and second power lines coupled to a pixel, wherein the power supply is to supply first and second voltages to respective ones of the first and second power lines in a display mode and is to supply third and fourth voltages to respective ones of the first and second power lines during an aging mode for aging an organic light emitting diode in the pixel, and wherein the timing controller is to withhold outputting at least one of a scan signal or a data signal to the pixel during the aging mode so that the pixel does not emit light during the aging mode and wherein a driving transistor and switches to control operation of the organic light emitting diode, including a switch coupled to an anode electrode of the organic light emitting diode, are off during the aging mode.

14. The apparatus as claimed in claim 13, wherein:

the first and second voltages are different in the display mode, and the third and fourth voltages in the aging mode are greater than at least one of the first or second voltages.

15. The apparatus as claimed in claim 14, wherein the third voltage is substantially equal to the fourth voltage.

16. The apparatus as claimed in claim 14, wherein:

the second voltage is greater than the first voltage, and the third and fourth voltages are substantially equal.

17. The apparatus as claimed in claim 13, wherein the third and fourth voltages are to generate Joule heat to age the organic light emitting diode in the pixel.

18. The apparatus as claimed in claim 13, wherein the power supply is to supply the third and fourth voltages during a module process or a setting process of a display panel including the pixel.

19. The apparatus as claimed in claim 13, wherein the power supply is to supply the third and fourth voltages before a scribing process and after the pixel is formed on a substrate.

20. A pixel, comprising:

a first transistor;

a driving transistor; and an organic light emitting diode having an anode electrode coupled to the first transistor and a cathode electrode coupled to a second power line, wherein the first transistor is coupled between a first power line and the organic light emitting diode, and the organic light emitting diode is coupled between the first transistor and the second power line, wherein the driving transistor and the first transistor are is in an off state and the first and second power lines receive substantially a same voltage during an aging mode, the same voltage to generate Joule heat to age the organic light emitting diode independent from receiving a scan or data signal.

* * * * *